United States Patent [19]

Lee

[11] Patent Number: 4,662,557

[45] Date of Patent: May 5, 1987

[54] GUIDE DIRECTED HAMMER HAVING SPEED MULTIPLYING MEANS

[76] Inventor: Lawrence L. Lee, 3776 Martha St., San Diego, Calif. 92117

[21] Appl. No.: 728,390

[22] Filed: Apr. 29, 1985

[51] Int. Cl.[4] ..... B25C 7/00

[52] U.S. Cl. ..... 227/147; 227/113; 227/129; 227/130; 74/110; 173/90

[58] Field of Search ..... 173/90; 227/129, 113, 227/147, 130; 74/110; 29/254

[56] References Cited

U.S. PATENT DOCUMENTS

| | | | |
|---|---|---|---|
| 52,799 | 2/1866 | Winter | 173/90 X |
| 1,406,027 | 2/1922 | Kabigting | 227/147 X |
| 2,587,944 | 3/1952 | Williams | 1/47 |
| 2,829,370 | 4/1958 | Humbert | 1/47 |
| 2,864,525 | 12/1958 | Hamlin et al. | 218/34 |
| 3,036,482 | 5/1962 | Kenworthy et al. | 81/52.35 |
| 3,042,004 | 7/1962 | Fischer et al. | 121/32 |
| 3,883,055 | 5/1975 | Abos | 30/367 X |
| 4,241,795 | 12/1980 | Landry, Jr. | 173/90 |
| 4,290,493 | 9/1981 | Smith et al. | 173/124 |
| 4,416,172 | 11/1983 | Medinger | 227/113 X |

FOREIGN PATENT DOCUMENTS

| | | | |
|---|---|---|---|
| 75539 | 11/1961 | France | 173/90 |

*Primary Examiner*—James M. Meister

*Attorney, Agent, or Firm*—Baker, Maxham & Jester

[57] ABSTRACT

A precision guided hammer or impact device includes a guide track on which is reciprocally mounted an impact member for movement between an impact position at one end of the guide member and a retracted position, and further includes a reciprocating manual input member which is connected by a multiplication linkage to the impact member for multiplying the input velocity for driving the impact member at a high velocity relative to the input velocity.

17 Claims, 8 Drawing Figures

GUIDE DIRECTED HAMMER HAVING SPEED MULTIPLYING MEANS

BACKGROUND OF THE INVENTION

The present invention relates to hand tools, and pertains particularly to a novel impact tool.

The hand held and manipulated hammer is perhaps one of the oldest and most widely used tools known to man. The hammer has a wide variety of uses and is utilized by a wide variety of people, both skilled and unskilled. The skilled carpenters use of a hammer for driving nails is perhaps the most well known use of the typical hammer.

Equally well known use of the hammer is that by the typical unskilled homeowner for the occasional driving of a nail. The unskilled use of a hammer for the driving of nails is frequently a frustrating and dangerous undertaking. In the typical use for driving nails, tacks and the like, the nail is held between the thumb and forefinger of one hand while the hammer is held by the handle in the other hand and used to strike the nail on the head until the nail has penetrated the article into which it is being driven to hold it in place. This is a hazardous undertaking for the unskilled, which frequently results in striking and injuring the fingers or hand. In addition, the unskilled user of the hammer frequently bends the nail before it can be driven to its final position because of his inaccuracy lack of skill in striking the nail.

The design of the typical hammer is such that it has an impact head on one end of an elongated handle. The handle is designed to be grasped in the hand at the end opposite the impact head in order to add leverage and increase the velocity of the movement of the hand at the hammer head to increase or multiply the impact of the hammer head on the nail or object being struck.

Because of this leverage resulting from the length of the hammer handle and the infrequent use of the hammer by the typical person he fails to develop skill in the use of the hammer. As a result of his lack of skill, the impact of the hammer head is inaccurate, such that it frequently results in missing the nail or bending it. The guidance of the hammer head of the typical hammer depends on the skill of the operator.

Accordingly, it is desirable that an improved hammer device be available which reduces the need for a skilled user.

SUMMARY AND OBJECTS OF THE INVENTION

Accordingly, it is the primary object of the present invention to provide an improved hammer.

In accordance with the primary aspect of the present invention, an improved hammer or impact device comprises a guide member on which is reciprocally mounted an impact member and an input member that is operatively connected to the impact member by means of multiplication linkage that multiplies the velocity of the input as applied to the impact member.

BRIEF DESCRIPTION OF THE DRAWINGS

The above and other object and advantages of the present invention will become apparent from the following description when read in conjunction with the drawings wherein.

DETAILED DESCRIPTION OF A PREFERRED EMBODIMENT

Figure 1:
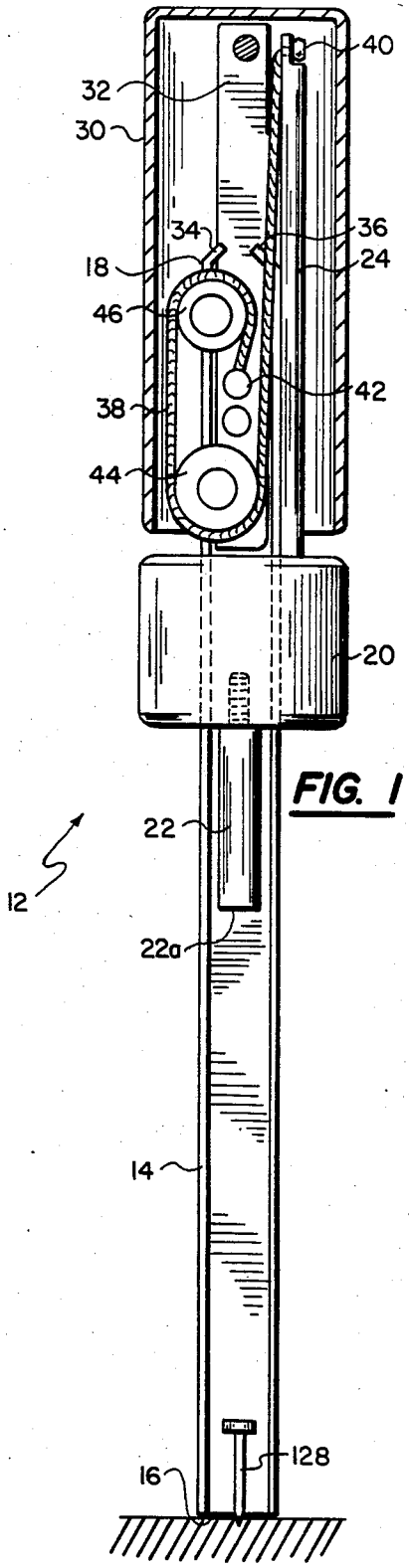
FIG. 1 is a front elevation view of the device in operation.
Figure 2:
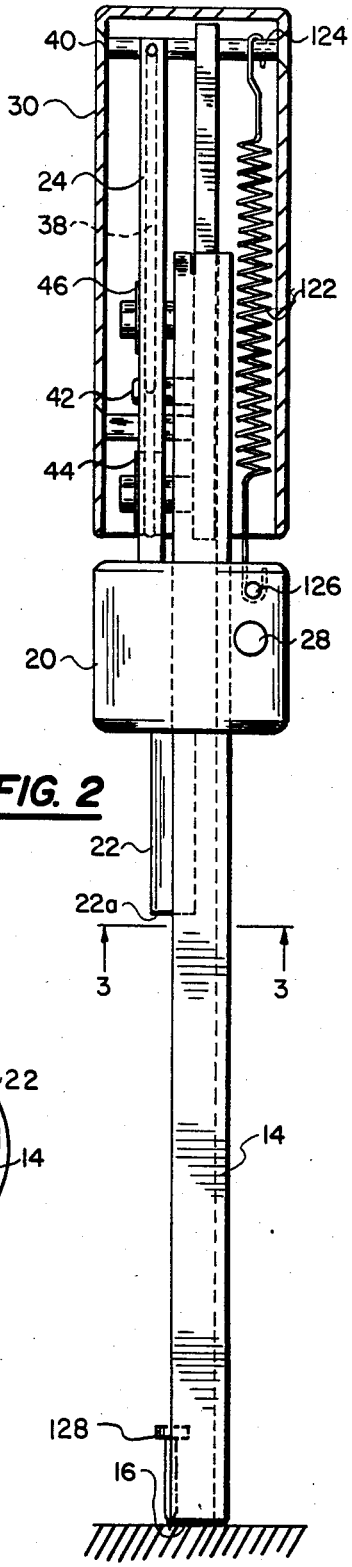
FIG. 2 is a side elevation view of the device of FIG. 1 showing further details of the mechanism.
Figure 3:
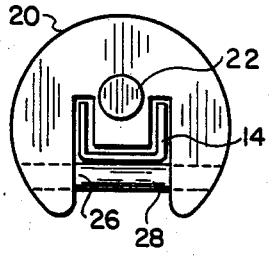
FIG. 3 is a cross section view taken generally on lines 3—3 of FIG. 2.

Referring to the drawings, particularly to FIGS. 1-3, an exemplary embodiment of the invention is illustrated. The illustrated embodiment comprises an elongated guide member 14 which, in the illustrated embodiment, comprises a U or C-shaped channel with a proximal end 16 which will be defined as the impact end and a distal end 18 which will be considered the handle or input end. Mounted for reciprocation along this guide member is an impact head or assembly comprising a generally cylindrical mass 20 having an impact or hammer head 22 and a connecting rod or link 24. The impact or hammer head 22 delivers the impact to the nail or article to be impacted. For purposes of illustration, the present device will be described in terms of a hammer for the driving of nails and the like, although it could obviously be used for other purposes. The channel or guide member 14 may take on any number of suitable configurations, such as tubular, circular, square, solid or any other configuration for guiding purposes.

The mass member 20 is mounted, as shown in FIG. 3, by means of a channel-shaped groove 26 therein permitting the mass to rest on or around the guide member 14. The impact assembly is retained in place on the guide member by a pin 28 extending through or across the open channel therein and behind the guide channel. The impact or hammer head 22 is detachably mounted on the mass 20 and extends forward therefrom toward the proximal or impact end 16 and and terminating in a suitable impact face 22*a*. The hammer head preferably has a length to enable the device to be utilized in confined or restricted spaces, and providing the appropriate or necessary clearance for the mass and the like. The mass 20 can have any number of configurations, but is preferably symmetric or balanced with respect to the axis of the impact head.

In the present assembly, in view of the accuracy of the impact, the head 22 need only be sufficiently large to insure covering the area to be impacted without undue attention to alignment. The head, or more particularly the impact face 22*a*, may have any suitable conventional hammer face configuration for any purpose as desired. The hammer head face may also be configured to form other tools such as a punch or a chisel.

Manual input means is mounted on the distal end 18 of the guide member and, in the illustrated embodiment, comprises a tubular member 30 connected or mounted on a slide member 32 which is reciprocally mounted in the channel of the guide member 14 and held in position therein by a pair of fingers 34 and 36 on the distal end of the guide member and other suitable guide means such as detents or the like along the channel. The tubular member 30 forms a handle to be grasped in the hand for the application of an input force or movement as will be described. The handle may have any number of forms or configurations.

The handle 30 is connected through the linkage or slide member 32 and a multiplication linkage to the impact assembly. The multiplication linkage functions to multiple the movement of the handle and transmit that multiplied movement to the impact assembly. Both the distance and velocity of movement is multiplied. In the illustrated embodiment, this multiplication linkage comprises a rope or cable and pulley arrangement. The term cable or rope is intended to include any form of flexible connector such as chains, tapes, wires, and the like. This arrangement comprises a cable 38 which is connected at one end 40 to the connecting rod 24 of the mass 20 and at the other end 42 to the slide member 32 of the handle 30. A traveling idler pulley 44 is rotatably mounted on the slide 32 and a fixed rotatable pulley 46 is mounted on the guide member 14. The cable 38 trails over these pulleys such that movement of the slide 32 carries with it the cable end 42 and the pulley 44 and the cable thus multiplying the movement of the link member 24 and the mass 20. Other arrangements of belts and pulleys or cables and pulleys may be utilized for multiplying the movement. Many variations can be utilized to multiply the input handle movement to the impact member anywhere up to ten or more times the movement of the input.

This translates the movement of the handle to the impact assembly with the momentum of the mass 20 transferring the momentum thereof through the impact head 22 to a nail or the like to be struck thereby. A spring 122 connected at one end, such as by a pin 126, to the mass 20 and at the other end by a pin 124 to the input member 30 retracts the impact assembly to the ready position for impact. The present arrangement has numerous advantages in that the impact head is guided on a positive guide to impact with the nail or whatever is being impacted. This has the advantage of being able to guide the impact to a precise point and eliminate the dangers of striking the hand and not the nail. In addition, it enables one to guide the impact member directly along the axis of the nail, insuring that the nail is driven rather than bent.

The apparatus may be constructed of any suitable size dictated by the application and the impact blows to be delivered. One embodiment, suitable for the driving of nails, has an overall length of 46 cm, a track 36 cm long, and a weight of about 0.8 Kg. The distance traveled by the mass 20 is about 24 cm. This impact device can deliver as much momentum or impact as an ordinary hammer weighing 0.8 Kg.

Figure 4:
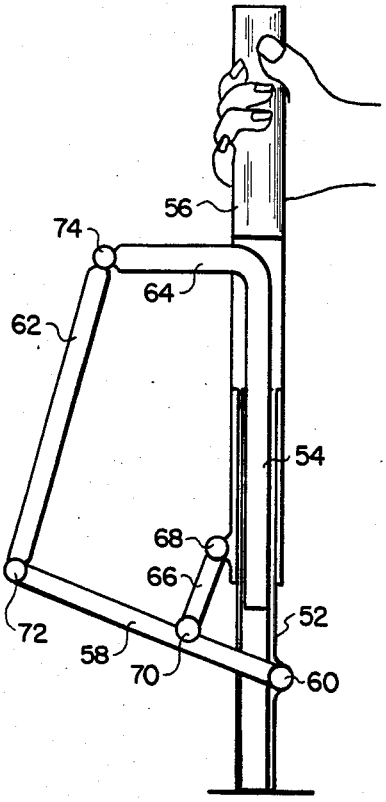
FIG. 4 is a side elevation view of an alternate embodiment of the invention.
Figure 5:
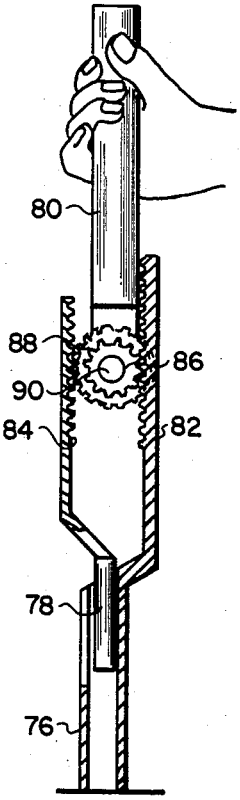
FIG. 5 is a side elevation view of another embodiment of the invention.
Figure 6:
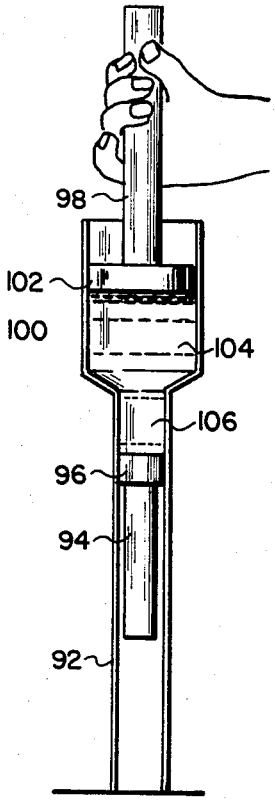
FIG. 6 is a still further embodiment of the invention.

Other possible multiplication linkages may be utilized, such as those schematically illustrated on FIGS. 4–6.

Referring to FIG. 4, an alternate embodiment is illustrated comprising a guide member 52 in a form of an elongated C-shaped channel member in which it is reciprocally mounted a mass or impact member 54. A handle 56 is reciprocally telescopically mounted on the guide member 52 and is connected by a multiplication linkage to the impact mass member 54. This linkage comprises a lever 58 pivotally connected at 60 to the guide member 52 and connected through pivots 72 and 74 by an elongated link member 62 to an arm 64 of the impact member 54. A link member 66 is pivotally connected at 68 to the handle member 56 and at a pivot connection 70 to a point intermediate the ends 60 and 72 of the lever 58. The position of the link connection 70 relative to the distances between the pivot points 60 and 72 determines the multiplication of the input velocity and movement. As will be apparent upon movement of the handle 56 toward the forward end of the guide member 52, the impact member 54 will be accelerated and moved at a multiplied velocity. Various factors of multiplication may be achieved by the differences in the lever arms of the lever 58.

Referring to FIG. 5, a still further embodiment is illustrated. In this embodiment, a guide member 76 having a generally tubular configuration reciprocally mounts a reciprocating impact member 78 which has a length sufficient for the forward end to extend at least to the distal end of the tubular guide member 76. A handle 80 is drivingly connected by a multiplication linkage means, which in this instance comprises a gear drive mechanism. The drive comprises a fixed rack member 82 mounted on an extension of the guide member 76 and a moveable guide or rack member 84 drivingly connected to the mass or impact member 78. The gear drive mechanism further comprises pinion gears 86 and 88 drivingly connected together and mounted for rotation on a shaft 90 carried on the handle 80. These gears drivingly engage the fixed rack 82 and the moveable rack 84 respectively with the multiplication being determined by the ratio of the diameters of the gears 86 and 88.

Referring to FIG. 6, a still further embodiment is illustrated wherein a guide member comprises an elongated tubular member 92 forming a piston chamber in which it is reciprocally mounted an impact member 94 having a piston 96 at the inner end thereof opposite from the impact end. An elongated handle 98 includes a piston 102 on an inner end thereof which is reciprocally mounted in a cylinder 100 which forms a stepped extension of tubular member 92. This arrangement forms axially connected gas or hydraulic chambers 104 and 106 with the multiplication of movement of the member 94 being determined by the volumetric ratio between the chambers 104 and 106. Any suitable fluid such as gas or hydraulic fluid may be utilized in the chambers 104 and 106. A spring return (not shown) may be necessary for the impact member 94 and piston 96.

These are illustrated examples of possible multiplication mechanisms within the concept of the present invention. Other multiplication mechanisms are possible within the scope and purpose of the invention.

Figure 7:
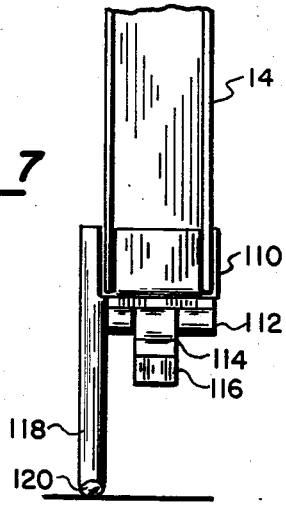
FIG. 7 is a front elevation view of a nail holding attachment for the embodiment of FIG. 1.
Figure 8:
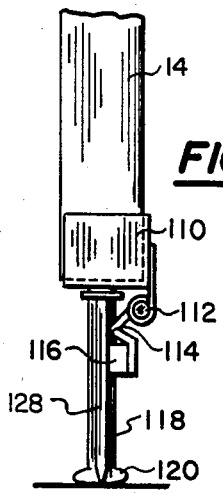
FIG. 8 is a side view of the embodiment of FIG. 7.

Referring to FIGS. 7 and 8, a nail holder attachment is illustrated. The holder comprises a body member having means forming a generally U-shaped socket for receiving the end of the guide member 14 in friction engagement. A shaft 112 is rotatably mounted in the end of the body 110 for pivotally mounting a holder arm 114 having means 116 in the form of a magnet for gripping a nail 128 or the like for holding it in place to be struck by the end 22*a* of member 22 for starting it. The holder arm 114 is shaped to form a cam member that projects out above the magnet for engagement by the impact member 22 as the nail is driven for camming the magnet 116 out of the way. Other forms of grippers such as clips or the like may be used for holding the nail, especially for non-ferrous nails. A spacer leg 118 having a foot 120 is attached to the holder body 110 for engaging the work surface and supporting the end of the hammer.

In operation, the handle 30 of the impact device is grasped in one hand and the impact end of the guide channel 16 or foot 120 is engaged with a support surface adjacent the object such as a nail to be impacted. The impact head 22 is aligned with the axis of a nail 128 (FIGS. 7 and 8), and the handle 30 is moved along the axis of the guide member 14 toward the nail forcing the impact head 22 to move along the channel 14 at a multiplied velocity until engagement of the impact face 22 with the nail head. The momentum in the moving mass is then transferred to the nail forcing it to be driven into the structure in which it is mounted.

One-third of the input force applied to the handle 30 is transmitted to the impact member 20, the other two-thirds goes to the impact end 16 (or 120) of the guide member. This keeps the impact end of the guide firmly pressed against the support surface and effectively prevents slippage. But the force on the impact end consumes no power: All the input power goes to the impact member 20 where one-third of the force generates three times the acceleration.

While I have illustrated and described my invention by means of specific embodiments, it is to be understood that numerous changes and modifications may be made therein without departing from the spirit and scope of the invention as defined in the appended claims.

I claim:

1. An impact apparatus for the multiplication and application of an input movement as an impact to a work piece, comprising:

elongated guide means;

input means mounted on said guide means for reciprocating movement between a rest position and an operative position;

an impact member mounted on said guide means for reciprocating movement between a rest position and an operative position for striking engagement with a work piece;

spring return means for returning said impact member to said rest position from said operative position;

speed multiplying means operatively connected between said input means and said impact member for positively moving said impact member from the rest position to the operative position, and for multiplying and transmitting an input motion of a given velocity of said input means from said rest position toward said operative position to said impact member toward said operative position at a multiple of the velocity of said given velocity of said input means.

2. An impact apparatus according to claim 1 wherein said support means comprises a linear guide track for confining said impact member to a linear path.

3. An impact apparatus according to claim 1 wherein:

said support means has at least a portion of which is stationary during transmission of an input motion to said impact member; and said input means comprises a handle for manual input, and multiplication linkage means operatively connecting said handle to said impact member.

4. An impact apparatus according to claim 1 wherein said multiplication linkage means comprises a flexible line and at least one pulley wherein one end of said line is connected to said impact member.

5. An impact apparatus according to claim 1 wherein:

said support means comprises an elongated member defining a linear track; and said input means comprises a handle reciprocable mounted on said elongated member.

6. An impact apparatus according to claim 1 wherein:

said multiplication and transmission means comprises cable means connecting said handle to said impact member.

7. An impact apparatus according to claim 1 wherein:

said cable means comprises a first pulley rotatably mounted on said handle, and a cable connected at one end to said impact member and trailing over said pulley.

8. An impact device according to claim 5 wherein:

said multiplication and transmission means comprises a gear train comprising a first rack gear secured to said guide member, a second rack gear connected to said impact member, and differential pinion gear means rotatably mounted on said handle means and drivingly interconnecting said first and said second rack gears.

9. An impact apparatus according to claim 1 comprising:

nail holding means for attachment to said support means comprising a pivoting arm and gripping means carried by said arm for gripping a nail.

10. An impact apparatus according to claim 9 wherein said gripping means comprises a magnet.

11. An impact apparatus for the application of an impact to a work piece, comprising:

an impact member;

support means comprising an elongated linear track for supporting said impact member for movement between a retracted position and an impact position;

input means comprising a handle reciprocably mounted on said linear track and multiplication and transmission means for multiplying and transmitting an input motion of a given velocity of said input member;

said multiplication and transmission means comprises cable means connecting said handle to said impact member; and said cable means comprises a first pulley rotatably mounted on said handle, and a cable connected at one end to said impact member and trailing over said pulley, a fixed pulley rotatably mounted on said guide member, and said cable trails over said fixed pulley and the other end thereof is fixed to said input member.

12. an impact apparatus according to claim 11 wherein:

said guide member is a generally U-shaped channel member; and said impact member comprises a mass substantially surrounding said channel and including an impact head extending forwardly therefrom.

13. An impact apparatus for the application of an impact to a work piece comprising an impact member comprising a mass including an impact head extending in a forward direction therefrom;

support means including an elongated generally U-shaped channel member defining a linear track for guiding and supporting said impact member for movement between a retracted position and an impact position, said impact member substantially surrounding said channel member; and input means including a handle reciprocably mounted on said elongated member for multiplication and transmission means comprising a first pulley rotatably mounted on said handle, a second pulley rotatably mounted on said guide member and a cable connected at one end to said impact member, trailing over said first pulley, and over said second pulley, and the other end thereof is connected to said input member for multiplying and transmitting an input motion of a given velocity of said input means to said impact member at a higher velocity than said input member;

a nail holding attachment comprising a body member having socket means for receiving the end of said channel member;

an arm pivotally mounted on said body member;

gripping means carried by said arm for gripping a nail; and cam means on said arm for engagement by said impact head for camming said arm and said gripping means out of the path of said impact head.

14. A manually operated impact apparatus for the multiplication and appliction of an input movement as an impact to a work piece, comprising:

an elongated linear guide track having a distal end to be positioned at a work piece;

an impact member comprising a body defining an inertial mass and an impact face connected to said mass mounted on said guide track for reciprocating movement along said guide track between a rest position and an operative position;

means on the distal end of said guide track for positioning a work member to be struck by said impact face;

input means including handle means for manual input for reciprocating movement between a rest position and an operative position mounted on said guide track; and speed multiplying including a linkage means operatively connecting said handle means to said impact member for positively moving said impact member from the rest position to the operative position and for multiplying and transmitting an input motion of a given velocity from said rest position of said input means to said impact member toward said operative position at a multiple of the velocity of said given velocity of said input means.

15. A manually operated impact apparatus according to claim 2 wherein:

said multiplication and transmission means comprises cable means connecting said handle to said impact member;

said cable means comprises a first pulley rotatably mounted on said handle, and a cable connected at one end to said impact member and trailing over said pulley.

16. A manually operated impact device according to claim 14 wherein:

said multiplication and transmission means comprises a gear train comprising a first rack gear secured to said guide member, a second rack gear connected to said impact member, and differential pinion gear means rotatably mounted on said handle means and drivingly interconnecting said first and said second rack gears.

17. A manually operated impact apparatus according to claim 14 comprising:

an elongated stepped diameter tubular member defining said guide member;

said impact member including piston means reciprocably mounted in a first diameter portion of said tubular member;

said handle including second piston means reciprocably mounted in a second diameter portion of said tubular member; and a fluid disposed in said tubular member between said first piston means and said second piston means for transmitting and multiplying movement of said second piston means to said first piston means and said impact member.

* * * * *